US011609055B2

(12) United States Patent
Colomine et al.

(10) Patent No.: US 11,609,055 B2
(45) Date of Patent: Mar. 21, 2023

(54) DEVICE FOR EJECTING AMMUNITION LINKS

(71) Applicant: JOHN COCKERILL DEFENSE SA, Loncin (BE)

(72) Inventors: Anthony Colomine, Mortier (BE); Innokenty Gritskevitch, Liege (BE)

(73) Assignee: JOHN COCKERILL DEFENSE SA, Loncin (BE)

( * ) Notice: Subject to any disclaimer, the term of this patent is extended or adjusted under 35 U.S.C. 154(b) by 0 days.

(21) Appl. No.: 17/612,580

(22) PCT Filed: Apr. 30, 2020

(86) PCT No.: PCT/EP2020/062145

§ 371 (c)(1),
(2) Date: Nov. 19, 2021

(87) PCT Pub. No.: WO2020/233964

PCT Pub. Date: Nov. 26, 2020

(65) Prior Publication Data

US 2022/0236023 A1 Jul. 28, 2022

(30) Foreign Application Priority Data

May 22, 2019 (EP) ..... 19175940

(51) Int. Cl.
*F41A 9/60* (2006.01)
*F41A 9/56* (2006.01)

(52) U.S. Cl.
CPC . *F41A 9/60* (2013.01); *F41A 9/56* (2013.01)

(58) Field of Classification Search
CPC ..... F41A 9/31; F41A 9/56; F41A 9/60; F41A 9/81

(Continued)

(56) References Cited

U.S. PATENT DOCUMENTS 2,815,699 A * 12/1957 Davis ..... F41A 9/37 89/33.25
3,704,772 A * 12/1972 Meier ..... F41A 9/02 414/217

(Continued)

FOREIGN PATENT DOCUMENTS

EP 2270418 A2 1/2011
WO WO 2018068984 A1 4/2018

*Primary Examiner* — Bret Hayes
(74) *Attorney, Agent, or Firm* — Leydig, Voit & Mayer, Ltd.

(57) ABSTRACT

A device for automatically discharging ammunition links obtained from a weapon configured to fire at a certain rate. The device includes a housing. The housing provides an inlet opening located in an upper position of the position for bulk insertion by gravity of the ammunition links obtained from the weapon after firing and an outlet opening for discharging the ammunition links toward an outside of the device at a given speed. The outlet opening is arranged laterally or offset relative to a vertical of the inlet opening. The device further includes a proximal ramp of the inlet opening connected to a proximal horizontal planar path of the outlet opening, two channeling rollers with parallel axes and inverse rotation relative to one another located at the proximal ramp, and two propulsion and guiding rollers located on either side of the proximal horizontal planar path.

8 Claims, 2 Drawing Sheets

(58) Field of Classification Search
USPC ..... 89/33.04, 33.14, 33.2, 33.4, 35.02
See application file for complete search history.

(56) References Cited

U.S. PATENT DOCUMENTS

| | | | | | |
|---|---|---|---|---|---|
| 4,563,936 | A * | 1/1986 | Cleary | F41A 9/37 | 89/33.04 |
| 4,601,230 | A | 7/1986 | Leblanc | | |
| 4,708,049 | A * | 11/1987 | Durant | F41A 9/35 | 89/33.17 |
| 5,109,752 | A * | 5/1992 | Yu | F41A 9/31 | 89/33.17 |
| 7,543,524 | B1 | 6/2009 | Javorsky | | |
| 7,578,226 | B2 | 8/2009 | Moucheboeuf et al. | | |
| 8,037,801 | B2 | 10/2011 | Coiffet et al. | | |
| 8,434,397 | B1 | 5/2013 | Deckard et al. | | |
| 8,607,683 | B1 * | 12/2013 | Burgermeister | F41A 9/31 | 89/34 |
| 9,506,705 | B1 * | 11/2016 | Fleischli | F41A 9/31 | |
| 10,739,092 | B2 | 8/2020 | Gritskevitch et al. | | |

* cited by examiner

DEVICE FOR EJECTING AMMUNITION LINKS

CROSS-REFERENCE TO PRIOR APPLICATIONS

This application is a U.S. National Phase application under 35 U.S.C. § 371 of International Application No. PCT/EP2020/062145, filed on Apr. 30, 2020, and claims benefit to European Patent Application No. EP 19175940.6, filed on May 22, 2019. The International Application was published in French on Nov. 26, 2020 as WO 2020/233964 A1 under PCT Article 21(2).

FIELD

The present invention relates to a device for automatically ejecting and discharging ammunition links, preferably, but not exclusively, coming from medium-caliber guns embedded in tank turrets. Medium-caliber ammunition typically has a diameter of between 15 and 50 mm.

The present invention also relates to an armored vehicle comprising the device for automatically discharging links.

BACKGROUND

At this time, systems for discharging ammunition links from weapons embedded in tank turrets are fairly large or cumbersome systems, characterized by an ejection that works solely by gravity. The links are either discharged from the outside of the shell of the turret or collected for example using a bag or a ramp.

Document U.S. Pat. No. 4,601,230 discloses an armored vehicle turret comprising a main weapon and a machine gun. The turret comprises a system for discharging links outside the turret, via two rigid chutes attached to the main weapon and to a compartment having two openings to the outside. The ejection chutes comprise guide strips for guiding the links. A hatch allows easy and ergonomic access to the discharge area.

Document U.S. Pat. No. 8,434,397 describes a mounting system for an automatic weapon for a vehicle such as a helicopter. The weapon mounting system comprises a weapon cradle supporting a machine gun. The assembly is connected to an inclined tubular support via a hollow cylindrical part. The hollow cylindrical part is located below the weapon and serves as a funnel in order to channel the cartridge cases and links into the cylindrical support used as discharge channel bringing the cartridge cases and links outside the passenger compartment of the helicopter.

Documents U.S. Pat. Nos. 7,578,226 and 8,037,801 disclose a device using a tab or a prong secured to the support of the weapon and making it possible to separate the links from a strip of ammunition, leaving the weapon after firing. These devices make it possible to pivot each link relative to the next one, thus detaching it from the strip of ammunition owing to the elasticity of the connections between the links. In the first case, the links arrive in the device with the single loop first and upwardly open, while in the second case, they arrive with the double loop first, downwardly open.

However, these systems for discharging links and ammunition have the drawback of still being based on the principle of gravity, which causes a significant risk of jamming the links in the chutes or between the turret and the vehicle, and clogging the discharge system. Furthermore, the discharge path is not well controlled.

SUMMARY

In an embodiment, the present invention provides a device for automatically discharging ammunition links coming from a weapon configured to fire at a certain rate, the device comprising a housing provided with at least the following: an inlet opening, located in an upper position of the housing, for bulk insertion by gravity of the ammunition links coming from the weapon after firing; an outlet opening for discharging the ammunition links toward an outside of the device at a given speed, the outlet opening being arranged laterally or offset relative to a vertical of the inlet opening; a proximal ramp of the inlet opening connected to a proximal horizontal planar path of the outlet opening; two channeling rollers with parallel axes and inverse rotation relative to one another located at the proximal ramp, separated by a gap able to allow the ammunition links to pass and to guide the ammunition links over the proximal ramp; two propulsion and guiding rollers located on either side of the proximal horizontal planar path and an actuator for actuating the channeling rollers and the propulsion rollers in a synchronized manner, wherein a speed of the two propulsion and guiding rollers is adjusted as a function of the firing rate of the weapon and determining the discharge speed of the ammunition links to the outside.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
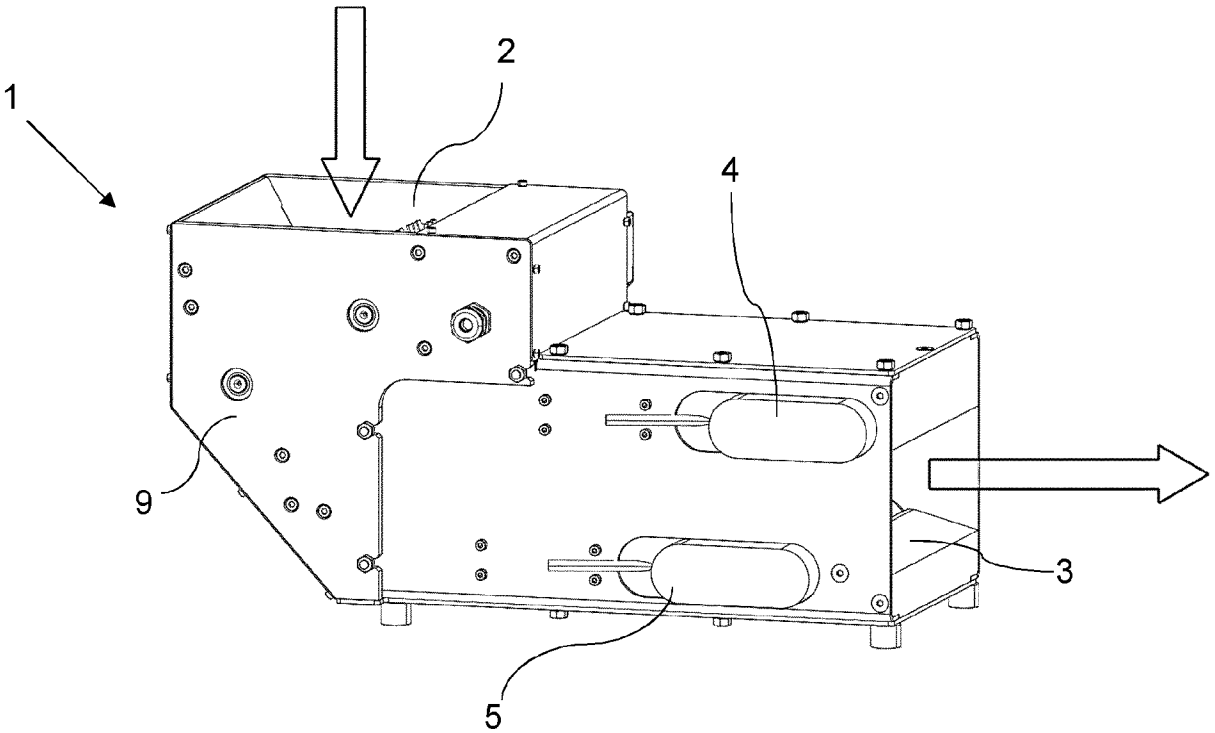
FIG. 1 shows a profile view of one example of a device for automatically discharging links according to the invention.

In particular, in an embodiment, the present invention provides a device for automatically discharging ammunition links, primarily coming from medium-caliber weapons, after shooting, the device being able to be embedded in tank turrets.

The desired result is for the ammunition links to be discharged or expelled as far as possible outside the turret, that is to say, at least 50 centimeters (cm) away from the turret, and following a controlled path so as not to encumber the passage for the following links and thus to avoid any clogging or scratching of the weapon.

Furthermore, the present invention provides a simple and reliable device, which is completely automated and does not involve any intervention by an operator during its operation. This improved device for discharging links makes it possible to obtain a rate of discharge of more than three links per second, continuously, given an average firing speed of the weapon of 200 shots per minute.

The device according to the present invention further provides an ejection of the links irrespective of the incline of the turret relative to the horizontal, and irrespective of the orientation and the position of the links upon at the entrance of the system.

The present invention also provides an armored vehicle comprising the improved device for ejecting links continuously.

A first aspect of the present invention relates to a device for automatically discharging ammunition links coming from a weapon able to fire at a certain rate, comprising a housing provided with at least the following elements, the specificities of which described hereinafter correspond to a usage configuration:

a first opening, called inlet opening, located in the upper position of the housing, for the bulk insertion by gravity of the links coming from the weapon after firing;

a second opening, called outlet opening, for discharging links toward the outside of the device at a given speed, the outlet opening being arranged laterally or offset relative to the vertical of the inlet opening;

a proximal ramp of the inlet opening connected to a proximal horizontal planar path of the outlet opening;

two channeling rollers with parallel axes and inverse rotation relative to one another located at the ramp, separated by a gap able to allow the links to pass and to guide them over the ramp;

two propulsion and guiding rollers, located on either side of the horizontal planar path;

means for actuating the channeling rollers and the propulsion rollers in a synchronized manner;

the speed of the propulsion rollers being adjusted as a function of the firing rate of the weapon and determining the discharge speed of the links to the outside.

According to specific embodiments of the invention, the device for automatically discharging ammunition links further includes at least one of the following features, or any suitable combination thereof:

the channeling rollers are two rotary brushes with parallel axes;

the propulsion rollers are conveyor belts with band or rollers;

the means for actuating the channeling rollers and the propulsion rollers in a synchronized manner comprise an electric motor and a driving system in the form of gears or belts;

the ramp has an incline relative to the vertical of between 15 and 50°;

the ramp has an incline of about 30° relative to the vertical;

the ratio of the distance traveled by the links over the horizontal planar path to the distance traveled over the ramp is between 1.5 and 3.

A second aspect of the present invention relates to an armored vehicle or tank turret comprising an automatic weapon able to fire at a certain rate, a hatch for discharging links to the outside, outside the armor, and a device for automatically discharging links as described above, characterized in that the device is placed in the vehicle or the turret such that the inlet orifice is located below the weapon to recover the links after firing by gravity in line with the weapon, and in that the outlet orifice is aligned with the hatch provided for discharging links to the outside, outside the armor, so as to be able to discharge the links to the outside with a speed determined by the firing rate.

Figure 2:
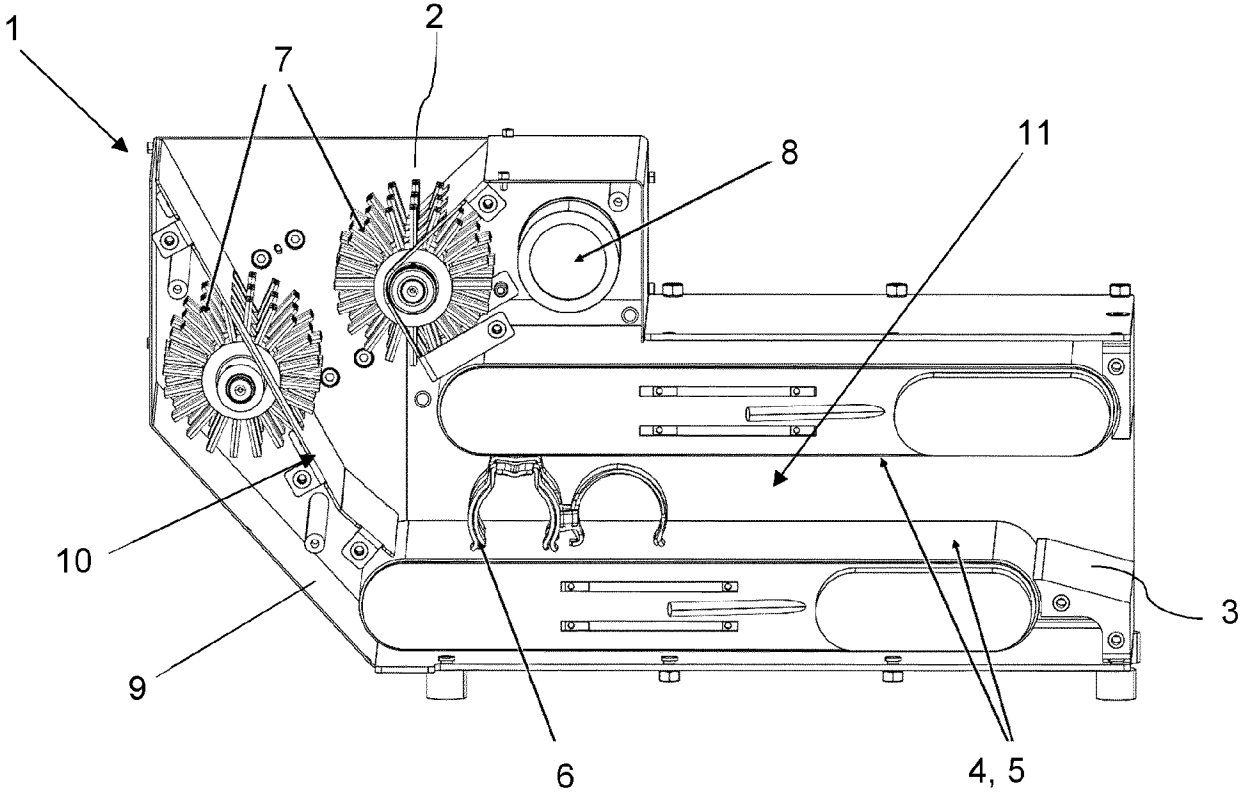
FIG. 2 shows an internal view corresponding to the device for automatically discharging links according to FIG. 1.

The present invention relates to a device 1 for automatically discharging ammunition links 6, as illustrated in FIGS. 1 and 2. The links preferably come from medium-caliber weapon ammunition. The device 1 can be provided on a tank turret, or any other armored vehicle, comprising a weapon system for example made up of a main weapon, such as a gun, and a machine gun.

According to one embodiment of the invention, the discharge device 1 comprises a housing that is normally closed 9 with the exception of a first opening 2 arranged in the high position and of large enough size to allow the bulk entry of links 6 coming from the weapon after firing, and a second opening 3, lateral or offset relative to the vertical of the opening 2, designed for the discharge of the links 6 to the outside of the device 1. During use, the device 1 may placed in the armored vehicle appropriately, that is to say, such that the inlet 2 is located exactly below the weapon to collect the links 6 after firing, and such that the outlet opening 3 corresponds to an opening in the armored vehicle making it possible to discharge the links 6 to the outside thereof with a certain speed.

The device for discharging links successively comprises, starting from the first opening 2 toward the second opening 3, a ramp 10 with an incline of between 15 and 50° relative to the vertical, preferably equal to about 30°, said ramp also being provided with at least two channeling rollers 7, located opposite one another and able to rotate in opposite directions. The separating gap between the two channeling rollers 7 is chosen to allow the links to pass and to orient them.

During use, these channeling rollers 7 make it possible to orient the links 6 that arrive via the inlet opening 2 in an appropriate position to prevent them from being blocked or from accumulating in the device 1, and can for example assume the form of two rotary brushes with parallel axes. At the bottom of the ramp 10, the links 6 are, during use, found on a horizontal path 11 delimited height wise by an upper propulsion roller 4 and a lower propulsion roller 5, the two rollers 4 and 5 guiding and advancing the links 6 to the outlet opening 3. The propulsion rollers 4, 5 can advantageously be of the carousel or conveyor belt type, advancing the links 6 owing to their respective moving belts. The device 1 further includes an electric motor 8 that makes it possible to respectively set both the channeling rollers 7 and the propulsion rollers 4, 5 in motion in a synchronized manner, via an appropriate drive system, for example in the form of gears or belts.

The propulsion rollers 4 and 5 define the ejection speed of the links 6 outside the device, and therefore outside the turret/armored vehicle. The speed of the propulsion rollers may depend on the rate of the weapon used, which may reach up to 300 shots per minute, and may be able to be adapted based on the weapon. The rollers and brushes used are standard equipment known in itself by one skilled in the art and are easily replaceable.

A first advantage of the device for discharging links according to the invention is that the efficiency of the ejection of the links will be good in all cases and will not depend on the incline of the turret or of the armored vehicle, knowing that the path of the links is random. This device therefore makes it possible not to face the issue of links accumulating at the outlet of a device based on gravity alone, or between the turret and the vehicle, by ejecting the links as far away as possible, and certainly at least 50 cm from the turret.

The device has the advantage of being able to be placed easily below any type of weapon, and being adaptable to the latter and to the type of vehicle incorporating the system. Preferably, the device is comprised in a tank turret, below the main weapon, thereby allowing the quick and efficient discharge of the links outside the turret.

The device according to the invention also makes it possible to reduce the size of the opening to the outside of the body or shell of the armored vehicle.

Another advantage of the present invention lies in offering a device that can be closed, which thus makes it possible to isolate the turret from the outside environment, for example in case of NBC (nuclear, bacteriological, chemical) conditions.

Still another advantage is that the device according to the invention assumes the form of an autonomous housing that can be placed in turrets that are already in use, optionally of different types or models.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE SYMBOLS

1. Device for discharging ammunition links
2. Inlet of the system (for inserting bulk links)
3. Outlet of the system (for ejecting links)
4. Upper link propulsion roller
5. Lower link propulsion roller
6. Links
7. Channeling rollers
8. Electric motor
9. Housing
10. Ramp
11. Horizontal path

The invention claimed is:

1. A device for automatically discharging ammunition links coming from a weapon configured to fire at a certain rate, the device comprising a housing provided with at least the following:

an inlet opening, located in an upper position of the housing, for bulk insertion by gravity of the ammunition links coming from the weapon after firing;

an outlet opening, for discharging the ammunition links toward an outside of the device at a given speed, the outlet opening being arranged laterally or offset relative to a vertical of the inlet opening;

a proximal ramp of the inlet opening connected to a proximal horizontal planar path of the outlet opening;

two channeling rollers with parallel axes and inverse rotation relative to one another located at the proximal ramp, separated by a gap able to allow the ammunition links to pass and to guide the ammunition links over the proximal ramp;

two propulsion and guiding rollers located on either side of the proximal horizontal planar path and an actuator for actuating the channeling rollers and the propulsion rollers in a synchronized manner, wherein a speed of the two propulsion and guiding rollers is adjusted as a function of the firing rate of the weapon and determining the discharge speed of the ammunition links to the outside.

2. The device according to claim 1, wherein the channeling rollers are two rotary brushes with parallel axes.

3. The device according to claim 1, wherein the propulsion rollers are conveyor belts with bands or rollers.

4. The device according to claim 1, wherein the actuator comprises an electric motor and a driving system comprising gears or belts.

5. The device according to claim 1, wherein the proximal ramp has an incline relative to the vertical of between 15 and 50°.

6. The device according to claim 5, wherein the proximal ramp has an incline of about 30° relative to the vertical.

7. The device according to claim 1, wherein a ratio of a distance traveled by the ammunition links over the horizontal planar path to a distance traveled over the proximal ramp is between 1.5 and 3.

8. An armored vehicle or tank turret comprising an automatic weapon configured to fire at a certain rate, a hatch for discharging links to the outside, outside the armor, and a device for automatically discharging links according to claim 1, wherein the device is disposed in the vehicle or the turret such that the inlet opening is located below the weapon to recover the links after firing by gravity in line with the weapon, and wherein the outlet opening is aligned with the hatch provided for discharging the links to the outside, outside the armor, so as to be able to discharge the links to the outside with a speed determined by the firing rate.

* * * * *